United States Patent [19]

Argazzi

[11] Patent Number: 4,645,060

[45] Date of Patent: Feb. 24, 1987

[54] DEVICE FOR SUPPLYING TUBES IN A POSITIVE MANNER TO THE PROCESSING LINE OF TUBE-FILLING MACHINES, AND PARTICULARLY TUBE-FILING AND BOXING MACHINES

[75] Inventor: Ivo Argazzi, Pianoro Nuova, Italy

[73] Assignee: I.M.A. Industria Maccine Automatiche S.p.A., Bologna, Italy

[21] Appl. No.: 749,879

[22] Filed: Jun. 27, 1985

[30] Foreign Application Priority Data

Jul. 18, 1984 [IT] Italy ..... 3529 A/84

[51] Int. Cl.[4] ..... B65G 25/00

[52] U.S. Cl. ..... 198/409; 198/468.2; 198/468.6; 198/457

[58] Field of Search ..... 198/409, 468.2, 468.6, 198/412, 457, 379, 468.01; 414/738, 739, 225, 226, 730

[56] References Cited

U.S. PATENT DOCUMENTS

| | | | |
|---|---|---|---|
| 2,914,162 | 11/1959 | Anger | 198/409 |
| 3,240,359 | 3/1966 | Ruesch et al. | 414/739 |
| 3,590,982 | 7/1971 | Banyas | 198/470.1 |

*Primary Examiner*—Joseph E. Valenza
*Assistant Examiner*—Jonathan D. Holmes
*Attorney, Agent, or Firm*—Karl F. Ross; Herbert Dubno

[57] ABSTRACT

A horizontal support has an angularly reciprocatable body supported in a horizontal and rotary manner and having an axially reciprocatable rod disposed therein and articulated to gripper designed to take horizontally disposed tubes in individual sequence and to transfer them, disposed vertically, with their bases upwardly open by inserting them from the top into resilient take-up members disposed with a uniform spacing along the processing line of the machine following oscillations of this body supporting the gripper.

1 Claim, 4 Drawing Figures

DEVICE FOR SUPPLYING TUBES IN A POSITIVE MANNER TO THE PROCESSING LINE OF TUBE-FILLING MACHINES, AND PARTICULARLY TUBE-FILING AND BOXING MACHINES

FIELD OF THE INVENTION

The present invention relates to a device for supplying tubes in a positive manner to the processing line of tube-filling and in particular tube-filling and boxing machines.

BACKGROUND OF THE INVENTION

The invention relates more precisely to a device which is particularly designed to supply in a positive manner preformed tubes of the so-called crushable type with open bases to the supply line of a tube-filling machine section of a tube-filling and boxing machine for processing and packaging preformed crushable tubular containers having an open base in boxes and a tube-filling and boxing machine for the automation of this method.

In accordance with this method, tube-filling and boxing machine substantially involve taking, from a supply hopper, the horizontally disposed tubes to be processed in individual succession and in a positive manner, to supply them in a free falling manner and to despatch them, still in a positive manner, i.e. so that they are controlled, to a member designed to insert them positively, from the horizontal take-up position, in a vertical arrangement with their open bases facing upwardly into resiliently acting take-up members of the processing line along which the tubes are moved in successive steps and are filled and have their bases, which form the actual base, sealed in a conventional manner. The tubes processed in this way, i.e. filled and with their bases sealed, are taken up rhythmically, by transfer members designed to insert them in respective prefabricated packaging boxes or containers having their filling apertures upwardly open, which members are displaced, still in a positive manner, in an identical rhythmic succession to a boxing station and are closed at this station inside the corresponding boxes with the subsequent closure of the filling aperture.

SUMMARY OF THE INVENTION

In the context of the positive transfer of the tubes in individual sequence from an initial take-up member to a subsequent take-up member so as to supply them to the processing line of the tube-filling and in particular the tube-filling and boxing machine, a device of the present invention comprises a horizontal support means for a detachable body supported in a rotary and horizontal manner having in its detachable portion gripper means designed to take the horizontally disposed tubes in individual sequence and to transfer them, disposed vertically, with their bases upwardly open, by means of insertion from the top into resilient take-up means disposed with a uniform spacing along the processing line of the machine following opposite oscillations of the body supporting the gripper means.

The present invention therefore relates to a device for the positive supply of preformed tubes of the so-called crushable type with their bases open to the processing line of tube-filling, and in particular tube-filling and boxing machines, the tubes being supplied in individual sequence and disposed horizontally by a movable rocker means with a horizontal alternating, reciprocating movement and the processing line comprising a plurality of uniformly spaced resiliently acting gripper means each formed by a single component having the shape of an upturned cup the periphery of which is provided with longitudinal slots, which device is characterised in that it comprises a horizontal support means disposed to the front of the horizontally movable rocker member, an axially reciprocatable rod supported horizontally in a rotary body by the horizontal support means, gripper means articulated to the rod portion of the rotary body, actuation and control means designed to control and actuate the opening and closing of the jaws of the gripper means and actuation and control means designed to control and oscillate the rod and rotary body in both directions and subsequently the gripper means in phase with the opening and closing of the corresponding jaws so as to take the horizontally disposed tubes from the rocker member with an alternating movement and transfer them, disposed vertically, with their bases upwardly open by means of insertion from the top into the resilient take-up members of the processing line of the machine.

BRIEF DESCRIPTION OF THE DRAWING

Further features and advantages of the invention will become more readily apparent from the following description, reference being made to the accompanying drawing, in which.

SPECIFIC DESCRIPTION

Figure 1:
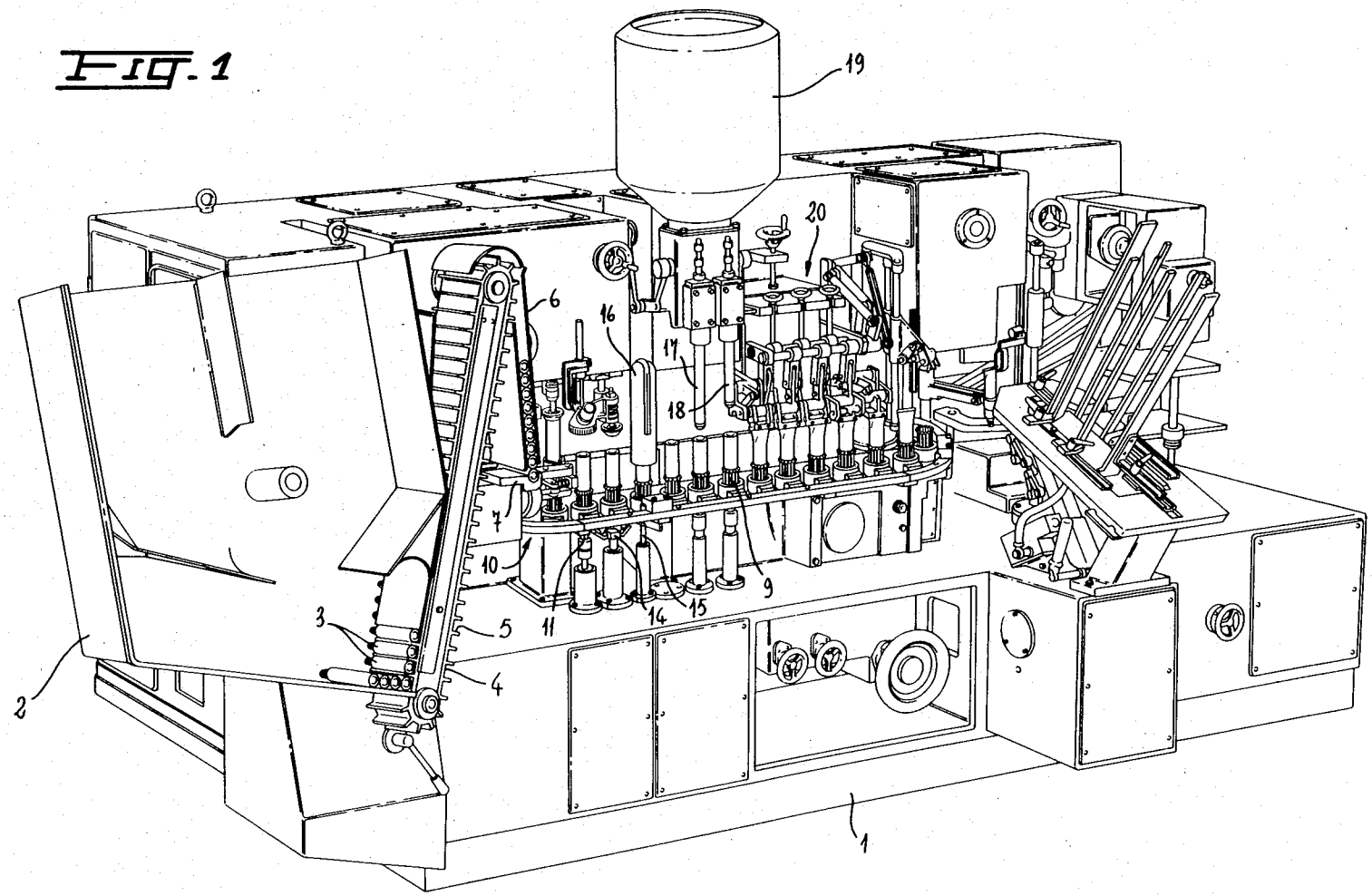
FIG. 1 is a partial front perspective view of the apparatus according to the invention.

With reference to FIG. 1, which shows an example of a possible practical embodiment of the tube-filling and boxing machine for automation of the method in accordance with the invention, it can be seen that this comprises an elongate base 1 which supports at one end (the left-hand end in FIG. 1), a container hopper 2 in which preformed tubes 3 having open bases are horizontally disposed.

This hopper 2 has its base inclined towards the center portion of the machine, and the right-hand wall of the container wall in FIG. 1, i.e. towards the center of the machine, is partially bounded in the lower area towards the base by an endless conveyor 4 of the type having take-up sections or pockets 5 for successive individual tubes 3. The conveyor 4 having sections 5 is disposed in an upwardly inclined manner towards the center of the machine and terminates at the top at the location of a guide duct 6 into which the tubes 3 are discharged.

This guide duct 6 is inclined downwardly with respect to the sectional conveyor 4 and terminates at its base at the location of a rocker transfer member 7 for the tubes 3, which are supplied thereto in individual sequence from the guide duct 6. This rocker transfer member 7 is provided with a horizontal reciprocating movement and may therefore transfer the tubes 3 in individual sequence and in a positive manner to a gripper element 8.

This gripper element 8, in addition to the synchronized opening and closing movement of the jaws 26 of the gripper for gripping the horizontally disposed tubes 3 while in the rocker of the corresponding transfer member 7, is also caused to oscillate in a rotary manner about a horizontal axis so as to be able to insert, still in individual sequence, the now vertically disposed tubes 3 having their bases upwardly open, into resilient take-up means 9 associated with endless conveyor means 10 in a horizontal plane, provided with a stepped movement and forming the processing line of the tube-filling section of the machine.

The vertically disposed tubes with their bases upwardly open are displaced along this processing line in such a way that they pause at successive operating stations such as, for example, a station for checking the presence of a closure stopper and for tightening the latter with means 11, for cleaning of the tube using a blowing and suction device 12, for centering the print using movable upper centering means 13 and rotary gripper means 14, and for the ejection of defective tubes by ejector means 15 via a reverse discharge duct 16 of the machine. The tubes are then moved further along the processing line and caused to pause at stations for filling, in two successive stages via the corresponding upwardly open base, using means 17 and 18 associated with a container 19 for the paste product, and for the sealed closure of this base, for example, by folding means, shown in its entirety at 20, for the end zone by flattening this zone of the tubes themselves, thereby sealing their bases.

At this point gripper means 21 are designed to take successively the closed and sealed tubes from the processing line and to transfer them into respective boxes having their filling apertures upwardly open. In the specific case shown in FIG. 1 of the attached drawings, the boxes are processed with their filling apertures open by taking blanks from a blank store 22. After the simultaneous supply and insertion of leaflets containing instructions for the use of the product into the boxes, these boxes are supplied to the box closure line of the boxing section of the machine, along which the closure of the filling aperture is carried out.

As mentioned above, the present invention relates to a device for the positive supply of preformed tubes of the so-called crushable type having open bases to the processing line of tube-filling machines and in particular tube-filling and boxing machines by taking the horizontally disposed tubes and inserting them, disposed vertically, with their bases upwardly open, by means of their insertion from the top into resilient take-up means disposed in a uniformly spaced manner along the processing line of the machine following a change of orientation of the tubes themselves.

Figure 2:
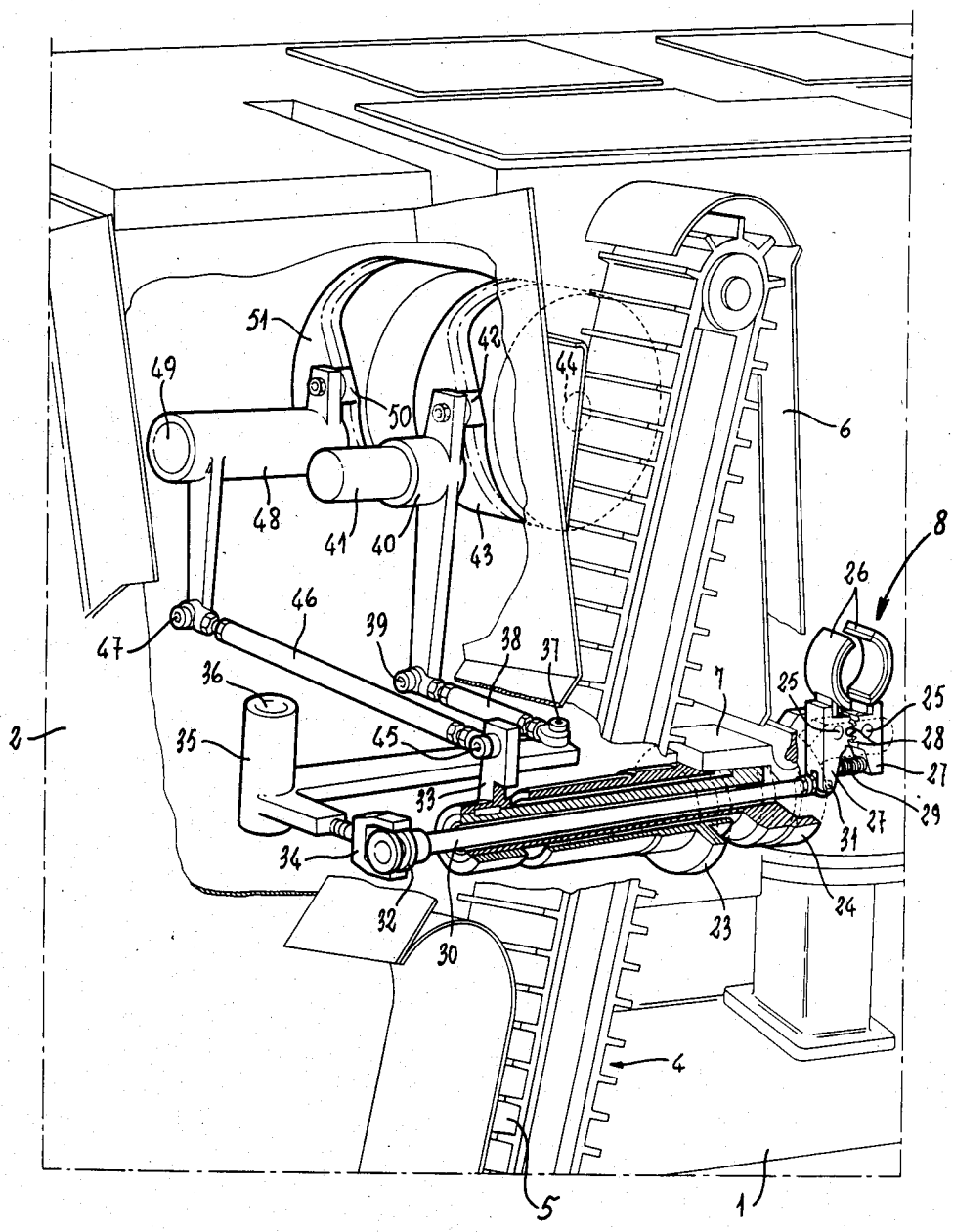
FIG. 2 is a perspective view of the device showing a detail of the apparatus of FIG. 1.

This device, shown in FIG. 2, is positioned at the front adjacent to the assembly formed by the sectional conveyor 4 and the chute 6 for supplying tubes 3 by means of the rocker member 7 which is caused to move horizontally with an alternating, reciprocating movement (see FIGS. 3 and 4 also) as described above and is substantially formed in accordance with the present invention by a support means 23 fixed to the base 1 of the machine and disposed horizontally in front of the rocker member 7 and by a body 24 supported horizontally in an angularly reciprocatable rotary manner by the horizontally fixed support means 23.

At the right-hand end in FIG. 2, there are articulated on the body 24 by the pivots 25 two semicircular jaws 26 opposite one another in the manner of a mirror image which act as grippers. The jaws 26 are each provided with a projection 27 whose intermediate portion is formed in a mirror-like manner as a respective toothed gear 28 in a reciprocal engagement relationship and below these toothed gears 28, there is provided an opposing spring 29 which tends to keep the jaws 26 shut.

A rod 30 is slidably engaged in an axially reciprocatable manner coaxially within the body 24, the right-hand end of this rod in FIG. 2 which projects from the body 24 being articulated at 31 on the adjacent projection 27 of the corresponding jaw 26, while the other end of this rod, which also projects from the body 24, is provided with a grooved ring 32.

A radial arm 33 is provided at the left-hand end of the body 24 projecting from the support means 23 in FIG. 2.

Figure 3:
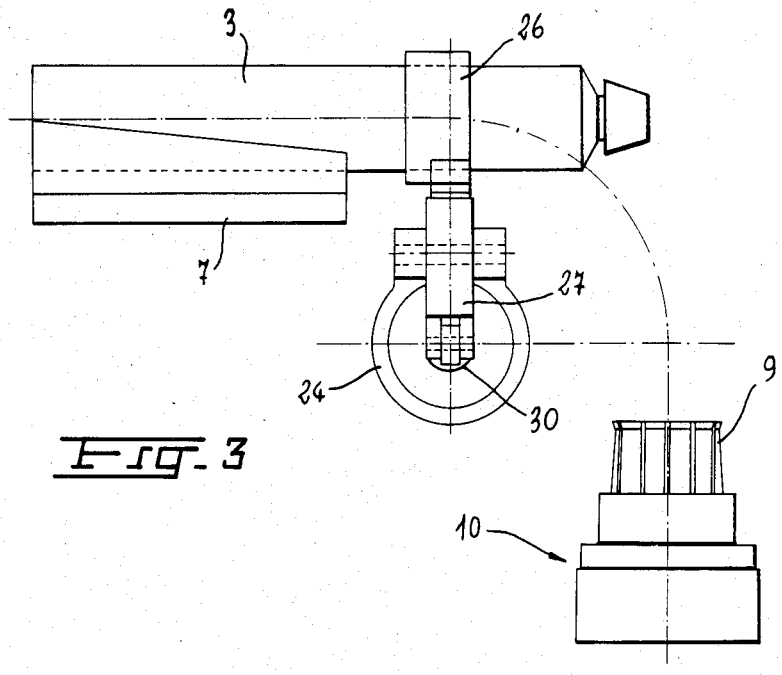
FIGS. 3 and 4 are detail views of two different stages of operation of the apparatus of FIG. 1.
Figure 4:
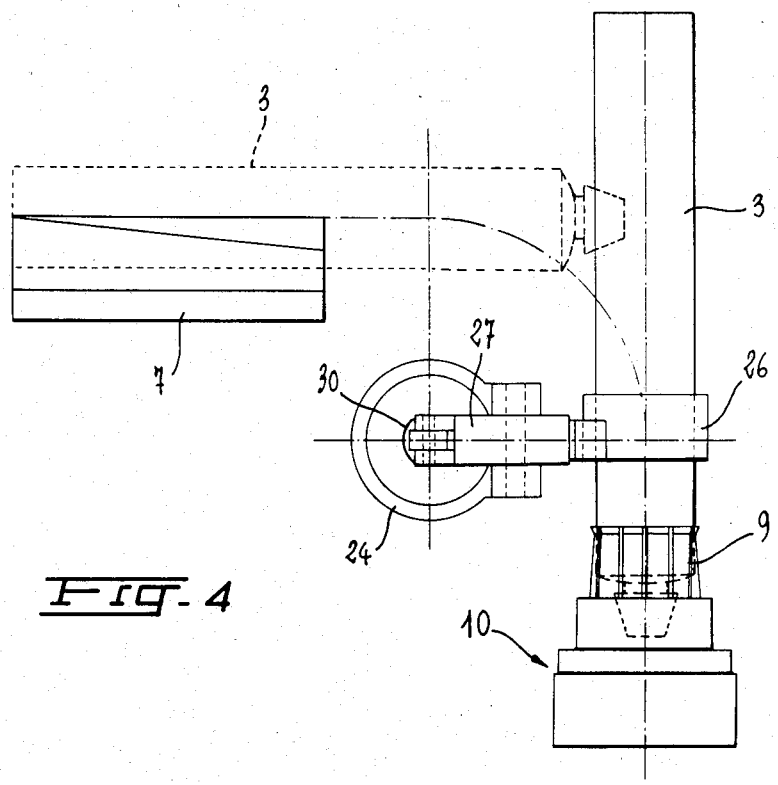

The grooved ring 32 and the radial arm 33 form the points of action of respective mechanisms for actuating and controlling the opening and closing of the jaws 26 and for the rotation, substantially through 90°, of these jaws 26 for the transfer in individual sequence of the tubes 3 from the rocker member 7 to insertion in the resilient take-up means 9 of the processing line 10 of the machine (see FIGS. 3 and 4).

In the groove of the grooved ring 32 there are engaged two diametrally opposed idler rollers (not visible in FIG. 2) supported by the prongs of a forked portion 34 provided at the free end of one of the arms of a two-armed lever 35 mounted to oscillate about a vertical axis 36, at the free end of whose other arm there is articulated at 37 the end of an adjustable tie-rod 38 whose other end is articulated at 39 on the end of one of the arms of a single two-armed lever 40 mounted to oscillate on a horizontal axis 41. At the free end of the other arm of this second two-armed lever 40 there is provided an idler roller 42 engaged in the groove of a cylindrical actuation and control cam 43 keyed on a shaft 44 driven by the machine.

At the free end of the radial arm 33 of the rotary body 24 there is articulated at 45 the end of an adjustable tie-rod 46 whose other free end is articulated at 47 on the free end of one of the arms of a two-armed lever 48 itself mounted to oscillate on a horizontal axis 49. At the free end of the other arm of this two-armed lever 48 there is provided an idler roller 50 engaged in the groove of a cylindrical control and actuation cam 51 also keyed on the shaft 44 driven by the machine.

All the specified purposes are achieved in practice with the construction described above of the device of the present invention. It is evident, however, that the above description, made with reference to the attached drawings, is given solely by way of example and it is therefore obvious that any modifications and variants suggested in practice and by the use of this device may be made to this construction, as long as they are based on and within the scope of the following claims.

I claim:

1. A transfer device for supplying crushable-type preformed tubes having bases thereof open toward a processing line lying along a transport path of a tube-filling machine, said tubes being supplied to said transfer device in individual sequence and horizontally disposed by a rocker member having a horizontally alternating reciprocatable movement, and a plurality of take-up members uniformly spaced along said transport path, each respective take-up member being formed by an upturned cup-shaped element having longitudinal slots formed around the periphery thereof and defining resilient fingers for holding a respective tube in a vertical orientation, said transfer device comprising:

a horizontal support member disposed adjacent said rocker member;

a rotary body supported horizontally and coaxially in said support member in an angularly reciprocatable rotary manner;

a horizontally disposed rod slidably engaged in an axially reciprocatable manner coaxially within said rotary body;

gripper means formed by a pair of opposed jaws in mutually meshing engagement pivotally mounted on said rotary body and reciprocatably movable toward and away from one another, one of said pair of jaws being articulated to said reciprocatable rod; and actuation and control means for operating said transfer device whereby said jaws are opened by the axial movement of said reciprocatable rod when said rocker member positions a horizontally disposed tube in registration with said gripper means and said gripper means is rotated by said rotary body into a position with said jaws thereof flanking said horizontally disposed tube, an axial movement of said reciprocatable rod closing said jaws on said tube, and an angular rotation of said rotary body transferring said horizontally disposed tube from said rocker member into a vertical position with the base thereof upwardly open toward said processing line and the tube being inserted into a respective take-up member by said gripper means, the respective jaws of said gripper means each having a semicircular shape open toward one another for gripping a respective cylindrical tube in an even manner, said jaws being in meshing engagement with one another whereby movement of the one jaw causes movement of the other jaw, the opening movement of said jaws being opposed by a spring.

* * * * *